US007690816B2

(12) United States Patent
Tyson et al.

(10) Patent No.: US 7,690,816 B2
(45) Date of Patent: Apr. 6, 2010

(54) LED LIGHTING SYSTEM

(75) Inventors: Glenn M. Tyson, La Crescenta, CA (US); Michael P. Leonhardt, Castaic, CA (US); Gabriel Perez, North Hollywood, CA (US)

(73) Assignee: ABL IP Holding LLC, Conyers, GA (US)

( * ) Notice: Subject to any disclaimer, the term of this patent is extended or adjusted under 35 U.S.C. 154(b) by 288 days.

(21) Appl. No.: 11/744,825

(22) Filed: May 4, 2007

(65) Prior Publication Data

US 2008/0273330 A1 Nov. 6, 2008

(51) Int. Cl.
*F21V 29/00* (2006.01)

(52) U.S. Cl. ..... 362/294; 362/800; 362/373

(58) Field of Classification Search ..... 362/294, 362/800, 373, 294.02
See application file for complete search history.

(56) References Cited

U.S. PATENT DOCUMENTS

| | | | | |
|---|---|---|---|---|
| 4,733,335 | A * | 3/1988 | Serizawa et al. | 362/503 |
| 5,198,962 | A | 3/1993 | Tyson | 361/679 |
| 5,276,583 | A | 1/1994 | Tyson | 361/679 |
| RE34,709 | E | 8/1994 | Tyson | 362/96 |
| 5,408,397 | A | 4/1995 | Tyson | 362/267 |
| 5,486,988 | A | 1/1996 | Tyson | 362/267 |
| 5,727,873 | A | 3/1998 | Tyson | 362/294 |
| 5,797,672 | A * | 8/1998 | Dobert | 362/190 |
| 6,068,384 | A | 5/2000 | Tyson et al. | 362/153.1 |
| 6,886,967 | B2 * | 5/2005 | Quang | 362/455 |
| 7,119,500 | B2 | 10/2006 | Young | 315/294 |
| 7,119,501 | B2 | 10/2006 | Young | 315/307 |
| 7,132,805 | B2 | 11/2006 | Young | 315/308 |
| 7,168,825 | B2 * | 1/2007 | McArthur | 362/267 |
| 7,217,006 | B2 * | 5/2007 | Trenchard et al. | 362/249.02 |
| 2002/0141196 | A1 * | 10/2002 | Camarota et al. | 362/372 |

* cited by examiner

*Primary Examiner*—Anabel M Ton
(74) *Attorney, Agent, or Firm*—Connolly Bove Lodge & Hutz LLP

(57) ABSTRACT

A fountain lighting system including a light engine head containing an LED light engine and a control housing containing control gear electronics includes a fixture support providing thermal separation between the light engine head and the control housing. The fixture support includes a lid with a bar extending from the edge thereof. The lid closes the control housing while the bar mounts the light engine head. An anchoring mount is also on the bar. The lid includes receptacles for receiving power, control and light engine cables with wicking barriers separating the various components provided in the lid itself. Temperature sensors in the light engine head and in the control housing send data communication to the control gear electronics to limit power to avoid thermal loading. The control gear electronics modulates the power to prevent apparent cycling. A pool lighting system provides similar features in a niche. A gap open to the niche thermally separates the light engine head from the control housing.

19 Claims, 7 Drawing Sheets

LED LIGHTING SYSTEM

BACKGROUND OF THE INVENTION

The field of the present invention is light fixtures using LED light engines.

High output light fixtures have been developed for outdoor lighting applications. Such fixtures may be employed, given different configurations and levels of sealing, for ingrade architectural lighting, fountain lighting, pool lighting and the like. In each of these cases, the fixture is intended to be or may be submerged. Therefore, as a consequence, such lighting requires protection far exceeding conventional lighting systems and even elevated outdoor lighting systems.

When sealing and structural protection is required for outdoor lighting, issues are presented regarding heat buildup. Poor thermodynamic characteristics can dictate size and limit light output. Heat generating elements in such sealed environments can result in component damage and problems with the sealing integrity of the fixture itself.

Outdoor fixtures which have undertaken to overcome thermal difficulties and enhance sealing are disclosed in U.S. Pat. Nos. 5,198,962, 5,276,583, 5,408,397, 5,486,988, 5,572,873, 6,068,384, and RE34,709, the disclosures of which are incorporated herein by reference.

LED (light emitting diode) light engines have recently found applicability in the replacement of incandescent lamps for specific uses. Traffic lights and vehicle rear brake lights are two ubiquitous applications. LED light engines have the advantage that they can be controlled for color and intensity. Such light engines, however, are subject to performance limitations based on input electronics and temperature control. Control and monitoring of LED light engines is undertaken in the teachings of U.S. Pat. Nos. 7,119,500, 7,119,501, and 7,132,805, the disclosures of which are incorporated herein by reference. Even with such controls, the incorporation of high output LED light engines in rigorous outdoor environments remains a challenge.

SUMMARY OF THE INVENTION

The present invention is directed to high output lighting systems which employ an LED light engine and can withstand rigorous outdoor environments. These systems are contemplated for outdoor use where sealing and thermal effects are of concern. LED light engines are sensitive to thermal conditions and can be damaged by prolonged moisture.

In the present invention, a light engine head including a chamber, a lens assembly closing the chamber and an LED light engine. The chamber is sealed with the lens assembly closing the chamber. A control housing includes a cavity, control gear electronics in the cavity and a power supply. Particular protection is afforded for the lighting system.

In a first separate aspect of the present invention, a fixture support for the lighting system includes a lid closing the cavity of the control housing. A beam rigidly extending from one edge of the lid has a light engine head attachment location which displaces the light engine head from the control housing. The fixture support thus assists in sealing of the control housing and thermally separating that control housing from the light housing head. Thermally conductive potting material may further be employed where enhanced heat transfer is needed.

In a second separate aspect of the present invention, isolation of the control housing is facilely accomplished through the provision of first receptacles located in the lid of the housing which closes and seals the housing. These receptacles allow for both high voltage and low voltage power and control to be potted, creating wicking barriers in an easily fabricated environment. Such a system is contemplated for such environments as ingrade lighting, fountain lighting and pool lighting.

In a third separate aspect of the present invention, the LED light engine is associated with a thermally conductive plate which is fixed in the chamber of the light engine head. A first temperature sensor measures the temperature of the plate at one location and is in data communication with the control gear electronics. The control gear electronics are constructed and arranged to reduce power to the LED light engine with the temperature sensor reaching a predetermined threshold temperature profile. This is to insure protection of the fixture elements. The threshold temperature profile is adjusted to compensate for the thermal drop between portions of the LED light engine and the sensor to insure protection of each LED component of the engine. This power control is undertaken responsive to the rate of change of temperature to avoid visually apparent changes in light intensity. This consideration inhibits visible cycling of light intensity from a fixture.

In a fourth separate aspect of the present invention the LED light engine is associated with a thermally conductive plate which is fixed in the chamber of the light engine head. A first temperature sensor measures the temperature of the plate at one location and is in data communication with the control gear electronics. The control gear electronics are constructed and arranged to reduce power to the LED light engine with the temperature sensor reaching a predetermined threshold temperature profile. This is to insure protection of the fixture elements. The threshold temperature profile is adjusted to compensate for the thermal drop between portions of the LED light engine to insure protection of each LED component of the engine. A second temperature sensor is located on the control gear electronics to similarly reduce power upon the sensor reaching a predetermined threshold temperature profile. In this way, both the chamber of the light engine head and the cavity of the control housing can be thermally protected separately.

In a fifth separate aspect of the present invention, an open, underwater niche receives a light engine head and a control housing with the head and housing being separated by a gap open to the niche. These elements are stacked in the niche with the chamber being between the gap and a lens assembly. The lens assembly faces outwardly of the niche. This assembly can further accommodate a mounting ring including circulation holes extending radially outwardly of the niche and mounts the light engine head.

In a sixth separate aspect of the present invention, combinations of the foregoing separate aspects are contemplated for further advantage.

Accordingly, it is a principal object of the present invention to provide a high intensity LED lighting system capable of rigorous outdoor use. Other and further objects and advantages will appear hereinafter.

DETAILED DESCRIPTION OF THE PREFERRED EMBODIMENTS

Figure 1:
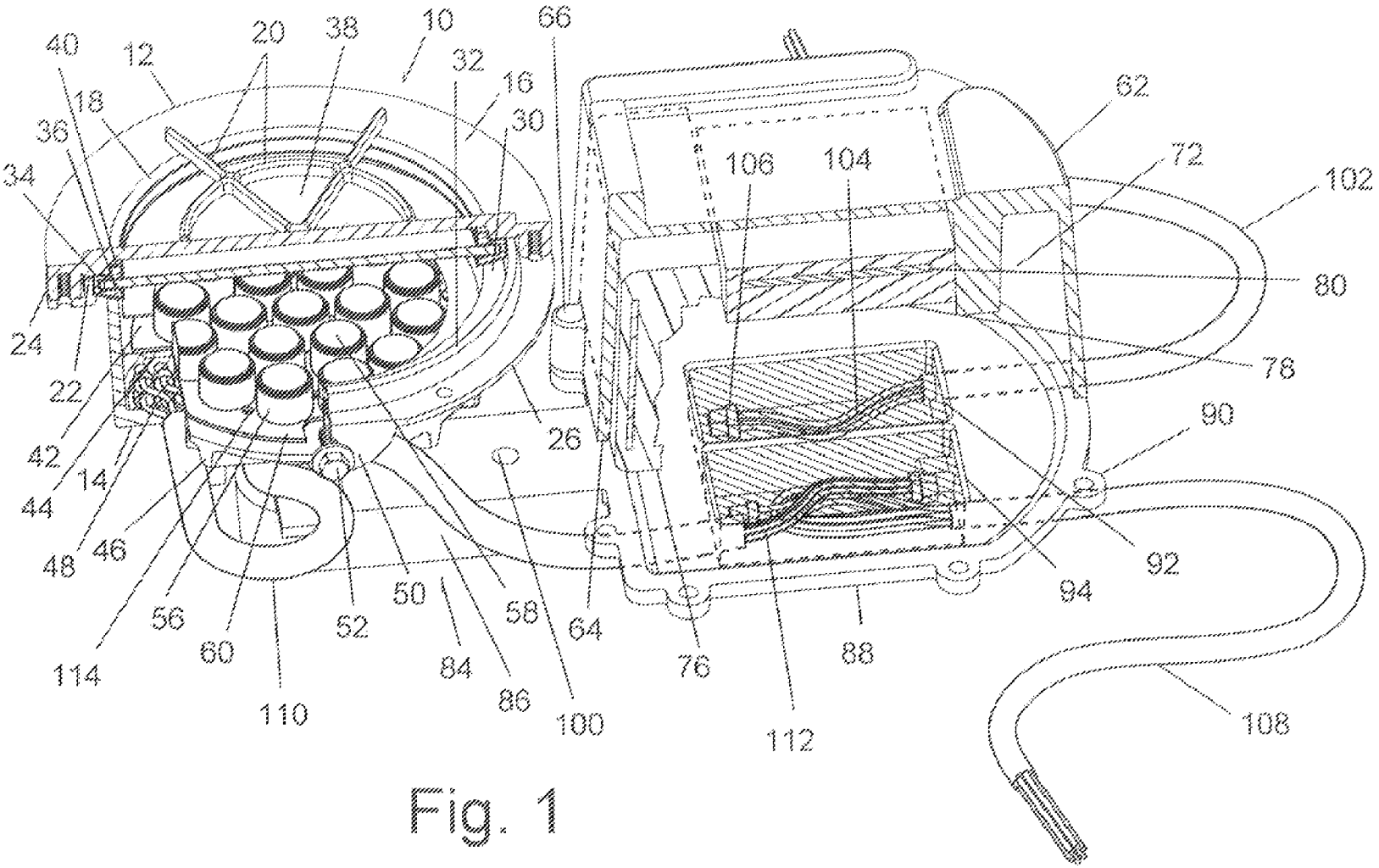
FIG. 1 is a perspective view of a first embodiment of a lighting system illustrating the wiring thereof.
Figure 2:
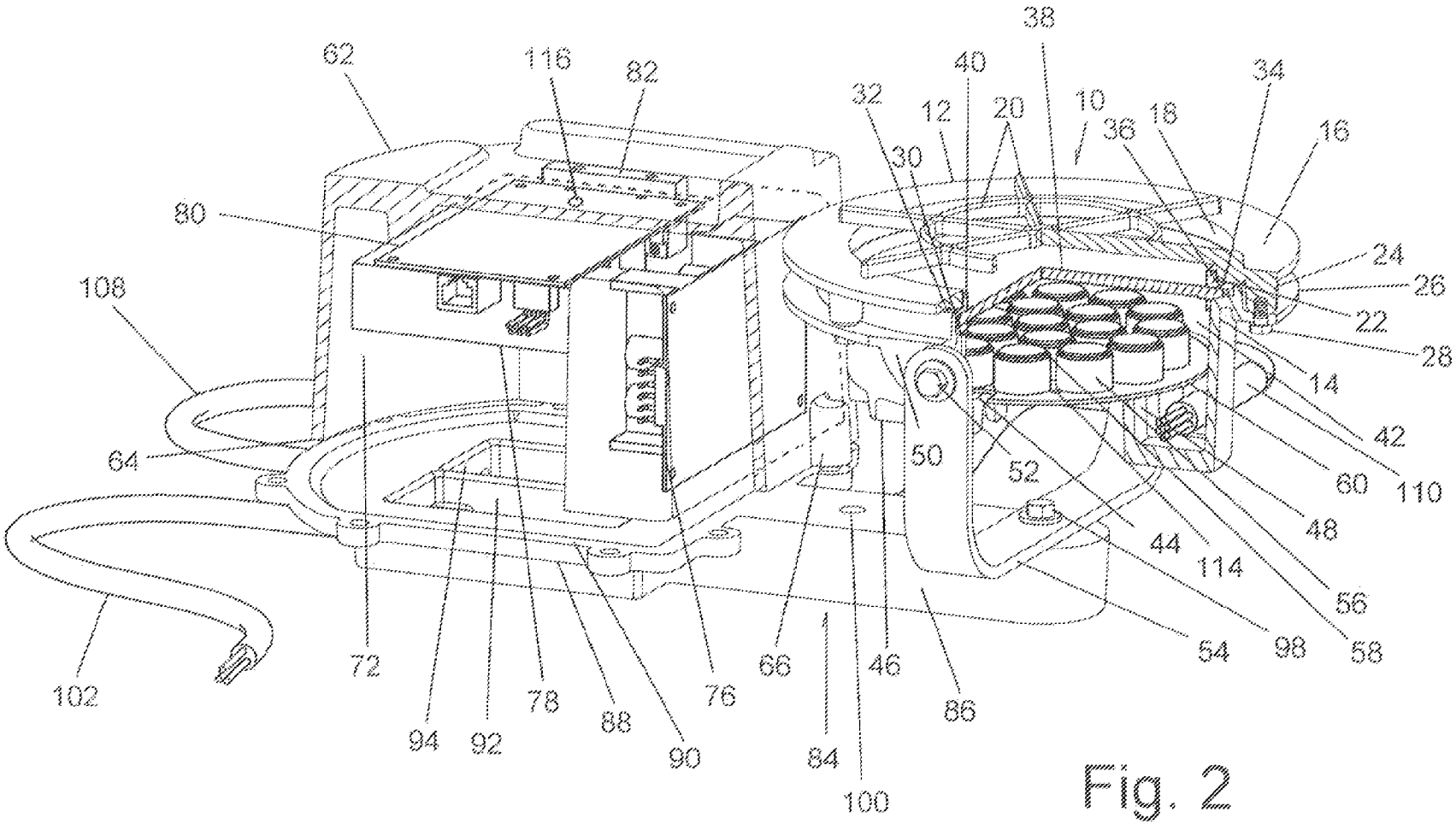
FIG. 2 is a perspective view of the lighting system of FIG. 1 illustrating the electronics thereof.

Turning to the drawings of the first embodiment, a fountain light fixture is illustrated. The fountain light fixture includes a light engine head 10 defined by two molded housing components 12, 14. The upper and lower components 12, 14 are preferably both electrically and thermally conductive. The upper component 12 includes an annular ring 16 having a circular opening 18 there through. Circular and radial bars 20 are integrally formed with the upper component 12 to extend across the opening 18. An annular mounting surface 22 extends radially outwardly from the opening 18. Bosses 24 extending about the annular ring 18 provide for attachment to the lower molded housing component 14.

The lower molded housing component 14 of the light engine head 10 also includes an annular ring 26. The bosses 24 seat upon the annular ring 26 and fasteners 28 extend through the annular ring 26 to engage the bosses 24 and retain the upper component 12. An annular mounting surface 30 on the lower component 14 faces the mounting surface 22 on the upper component 12. A cylindrical ring 32 radially outwardly of the annular mounting surface 30 extends to the mounting surface 22 when assembled.

The mounting surfaces 22 and 30 cooperate with the cylindrical ring 32 to define an annular seat for a gasket 34. The gasket 34 provides an interior groove 36 for receipt of a lens 38. The gasket 34 also includes an axially extending flange 40 for proper positioning within the opening 18 of the upper component 12. The gasket 34 is of elastomeric material and sized for an interference fit with the light engine head 10 when the upper and lower components 12, 14 are assembled thereabout.

The lens assembly including the lens 38 and gasket 34 closes and seals the chamber 42 defined within the upper and lower components 12, 14. The chamber 42 has an annular shelf 44. Cooling fins 46 are arranged on the outside of the lower component 14. A potting cavity 48 extends downwardly from the annular mounting surface 30.

Two mounting bosses 50 are axially aligned on either side of the lower component 14 to receive pins or bolts 52. These elements 52 receive a mounting yoke 54. The mounting yoke 54 of the light engine head 10 is pivotally mounted through the elements 52 about an axis parallel to the plane of the annular ring 26.

Located within the light engine head 10 is an LED light engine 56. This light engine 56 includes a number of LED units 58 which are preferably a mix of red, green and blue for controlled colors and blendable as white light. The LED light engine 56 is mounted on a thermally conductive plate 60. This plate 60 is mounted to a shelf 44 defined in the lower component 14 of the light engine head 10. The contact between the plate 60 and the shelf 44 may be enhanced by a thin film of thermally conductive grease or putty, in that position, the LED light engine 56 is directed toward the opening 18 to direct light through the lens 38.

Figure 3:
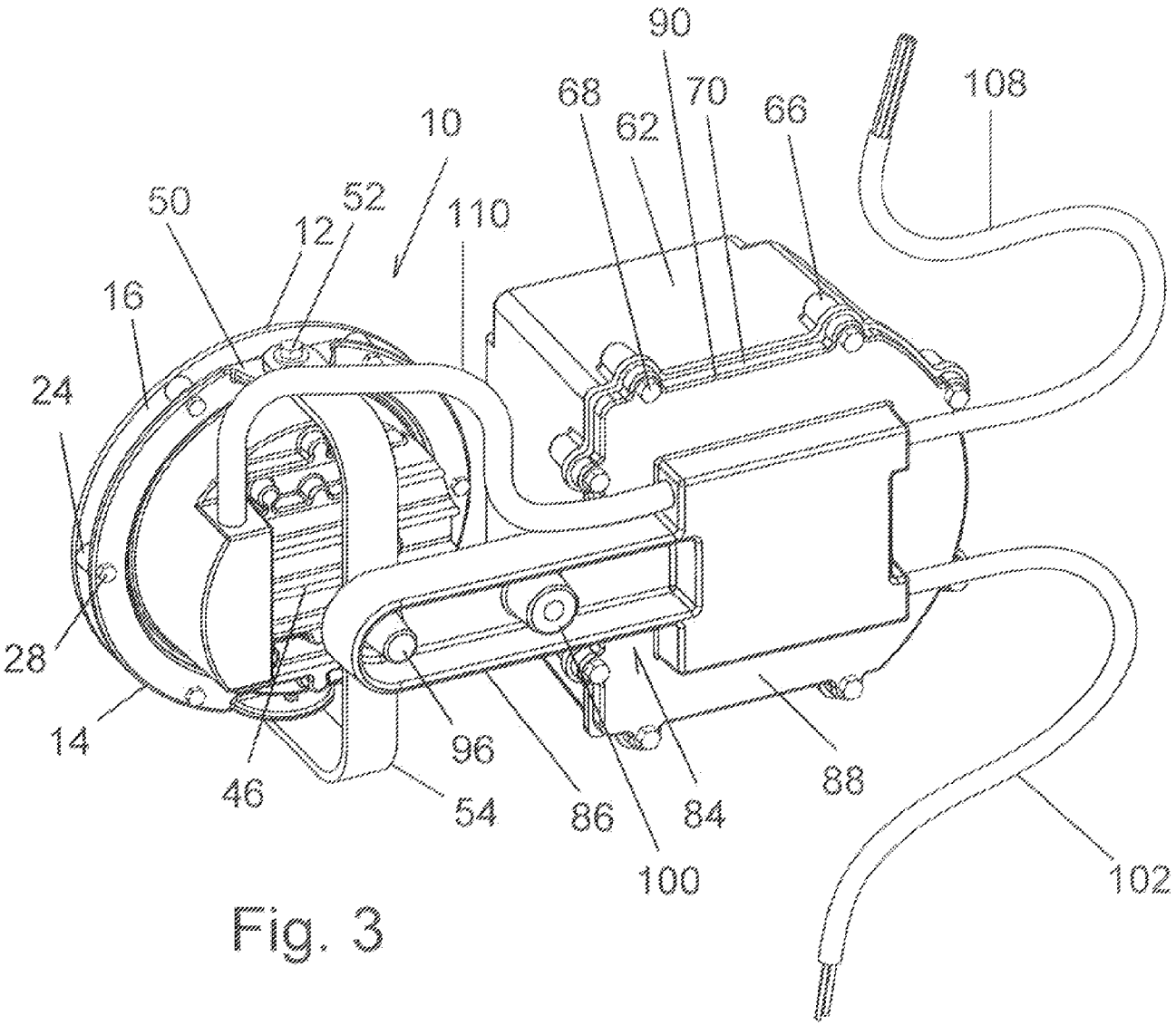
FIG. 3 is a back perspective view of the lighting system of FIG. 1.
Figure 4:
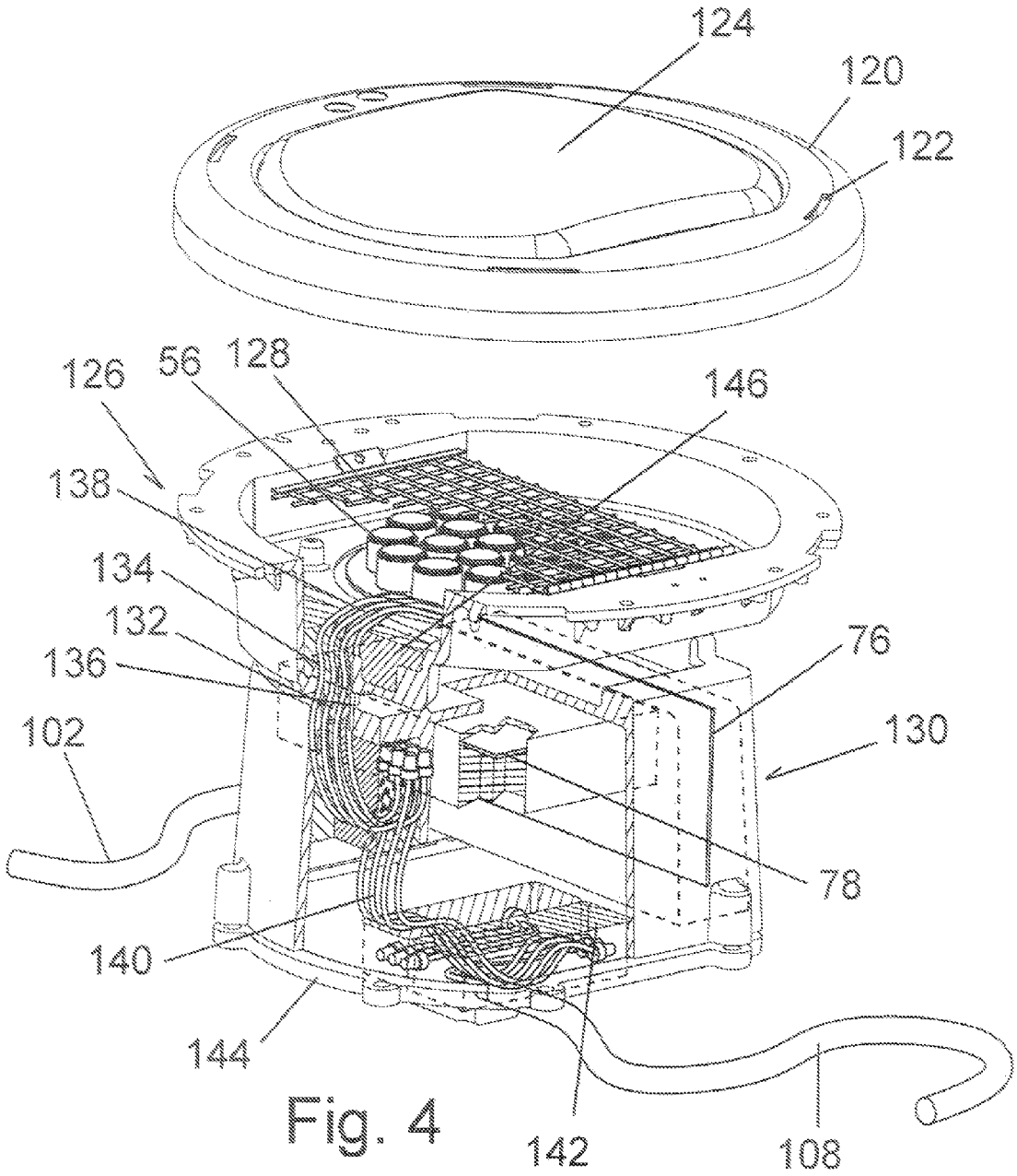
FIG. 4 is a perspective view of a second embodiment of a lighting system illustrating the wiring thereof.
Figure 5:
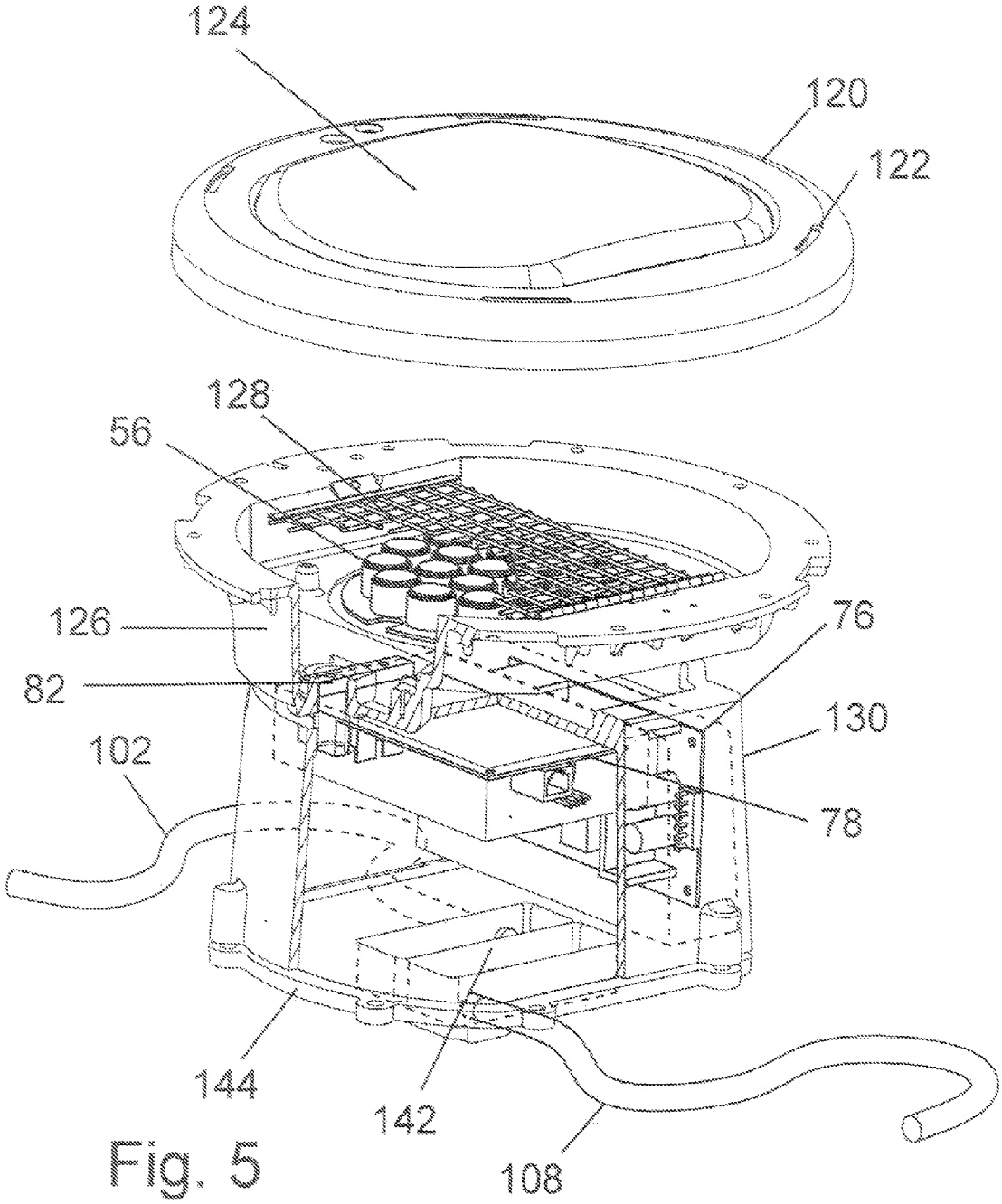
FIG. 5 is a perspective view of the lighting system of FIG. 4 illustrating the electronics thereof.
Figure 6:
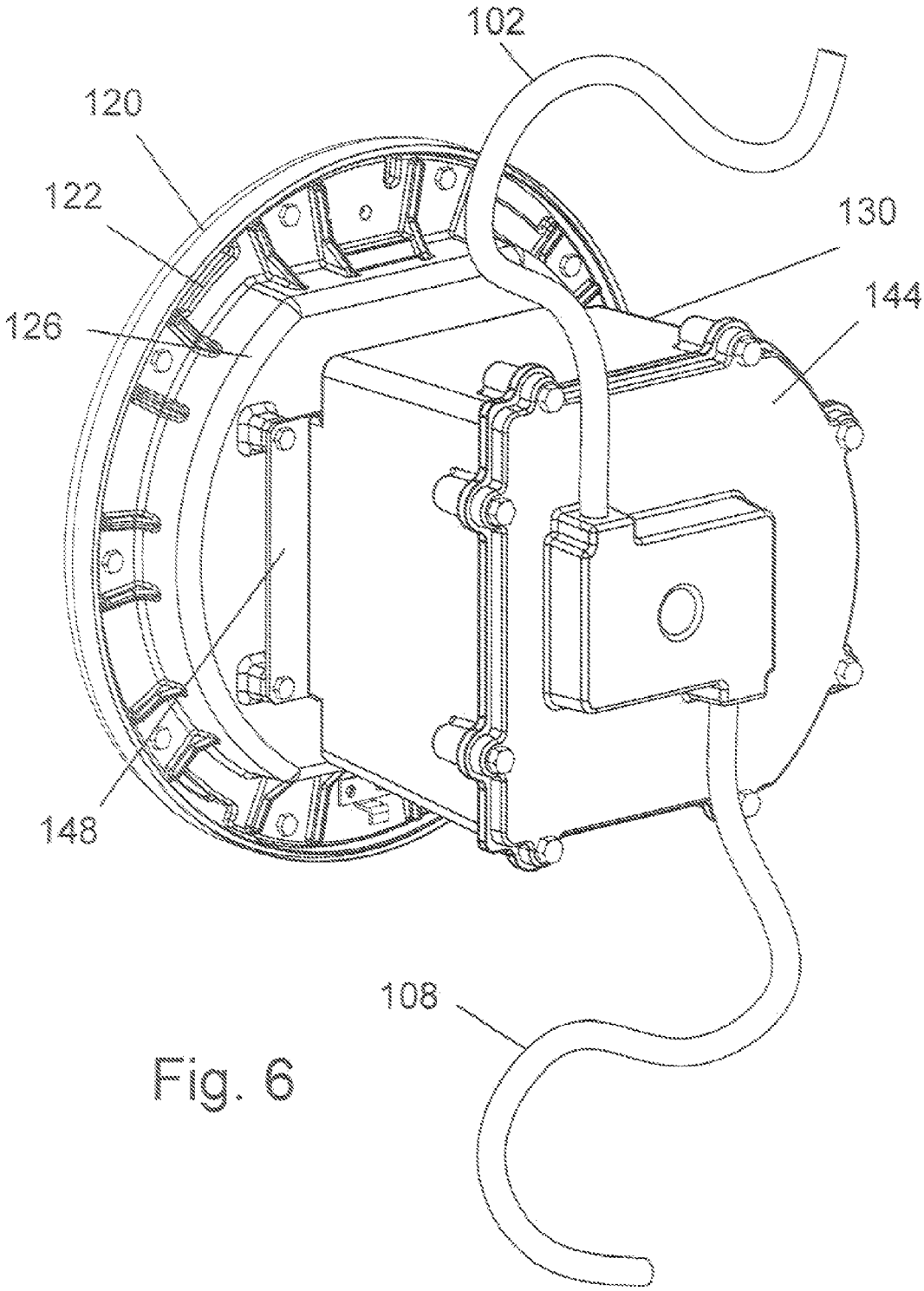
FIG. 6 is a back perspective view of the lighting system of FIG. 4.

A control housing 62 is also preferably molded of electrically and thermally conductive material. The control housing 62 is open on one side, defining a mounting edge 64 with bosses 66 for receiving fasteners 68. The opening further receives a gasket 70 for sealing of the interior as illustrated in FIG. 3. A cavity 72 is defined within the control housing 62.

A power supply 76 is located within the cavity 72 of the control housing 62. The power supply reduces the voltage from line voltage to 24 volts and also acts to rectify the current and shape the pulses. The power supply 76 is encased in thermally conductive polling material which is in turn fully in contact with the control housing 62 for heat transfer from the power supply 76 to the housing 62 for dissipation of heat.

Also located within the cavity 72 of the control housing 62 is control gear electronics 78 positioned on a circuit board 80. The circuit hoard 80 with the control gear electronics 78 are also fully encased in thermally conductive potting material. The thermally conductive potting material is again engaged with the control housing 62 for transfer of heal to the housing for dissipation. A block of heat conductive material, such as copper, defines a heat sink 82. the block 82 is integrated with the circuit board 80 adjacent to field effect transistors (not shown) which are a source of substantial heat. With the heat sink 82 thermally coupled with the control gear electronics, the assembly is fully potted in the thermally conductive potting material for heat transfer to the control housing 62. The control gear electronics 78 control the LED light engine 56 according to known systems. Reference is again made to U.S. Pat. Nos. 7,119,500, 7,119,501, and 7,132,805 which are incorporated herein by reference above.

A fixture support, generally designated 84, ties the light engine head 10 and the control housing 62 together and yet thermally separate and displaced from one another. The fixture support 84 includes a beam 86 with a lid 88 at one end. The beam 86 is connected to the lid 88 at one edge of the lid. The lid closes the opening in the control housing 62 with a flange 90 placed against the gasket 70 to seal the cavity 72.

Two receptacles 92, 94 arc located on the inside of the lid 88 facing the cavity 72. These two receptacles are each ported to the outside of the lid 88 to receive cables. The receptacles 92, 94 have sufficient depth to receive the cables and wires extending therefrom for forming junctions and subsequent potting.

The beam 86 extends rigidly from the lid 88. A light engine head attachment 96 is located adjacent the end of the beam 86. A tapped threaded hole forms the lighting head attachment 96. The mounting yoke 54 of the light engine head 10 is pivotally fastened to the beam 86 by a bolt 98. The axis of the pivotal fastening is normal to the axis of the elements 52 in order to form a gimbaled relationship. In this way, the light engine head 10 can be positioned at a wide range of angles, the locus of which approaches a hemisphere.

Between the light engine head attachment 96 and the lid 88. A fixture attachment 100 opens in the opposite direction from the light engine bead attachment 96 and from the control housing 62. The fixture attachment 100 is between the light engine head attachment 96 and the lid 88. The fixture attachment 100 is for potential mounting to a supporting substrate.

A power cable 102 brings power to the lighting system. The sheath of the power cable 102 extends into the receptacle 92 in the lid 88. Wires 104 within the sheath of the power cable 102 are then exposed with the ends of the wires 104 stripped bare. Pigtails 106 are placed on the ends of the wires 104 to join with lead wires (not shown) which run to the power supply 76. Potting compound is then poured into and cured in the receptacle 92 to form a wicking barrier around the bare wire ends of the wires. A ferule may be placed around the end of the power cable 102 to prevent retraction and strain on the potting material within the receptacle 92. Similarly, a control cable 108 extends through the lid 88 into the receptacle 94 in the same manner, this control cable is joined with leads (not shown) to the control gear electronics 78 with wicking barriers similarly formed.

A light engine cable 110 extends from the receptacle 94 and through the lid 88 to the light engine head 10. The light engine cable 110 is similarly treated as the control cable 108 and the power cable 102 in termination within the receptacles. Lead wires (not shown) from the control gear electronics 78 are joined with the bare ends of the wires of the light engine cable 110 to drive the LED light engine 56. The wires 112 in the sight engine cable 110 extend info the potting cavity 48 located in the light engine head 10 in a similar manner to that of the other end of the light engine cable 110 in the receptacle 94. Leads to the LED light engine 56 are joined with these wires 112, forming wicking barriers in the potting material found in the potting cavity 48. Thus, the chamber 42 and the cavity 72 are completely isolated from one another.

A temperature sensor 114 is located on the thermally conductive plate 60 to monitor the temperature of that plate. This temperature sensor most advantageously a thermistor, is in data communication with the control gear electronics 78. The location of the thermistor 114 is conveniently arranged. However, the system is adjusted to compensate for the thermal drop between portions of the thermally conductive plate 60 so as to anticipate overheating of the LED light engine 56 at any more vulnerable locations.

The control gear electronics 78 receives the data communication representing the temperature of the thermistor 114. The electronics 78 are constructed and arranged to measure the rate of change of the data and vary the power input to the LED light engine 56 responsive to the rate of change of that temperature. With the electronics 78 sensing the LED light engine 56 approaching an overheated condition, power is reduced using techniques presented in the aforementioned control patents. Such actions are taken when the data communication reflects the reaching of a predetermined threshold temperature profile. The response is such that there is no on/off cycle or any cycling that would be visibly noticeable.

A second temperature sensor 118 is on and in data communication with the control gear electronics 78. This second temperature sensor 116 also provides input for the electronics 78 to reduce power with the sensor 118 reaching a predetermined threshold temperature profile. In this way both the LED light engine 56 and the control gear electronics 78 can be protected from overheating.

Figure 7:
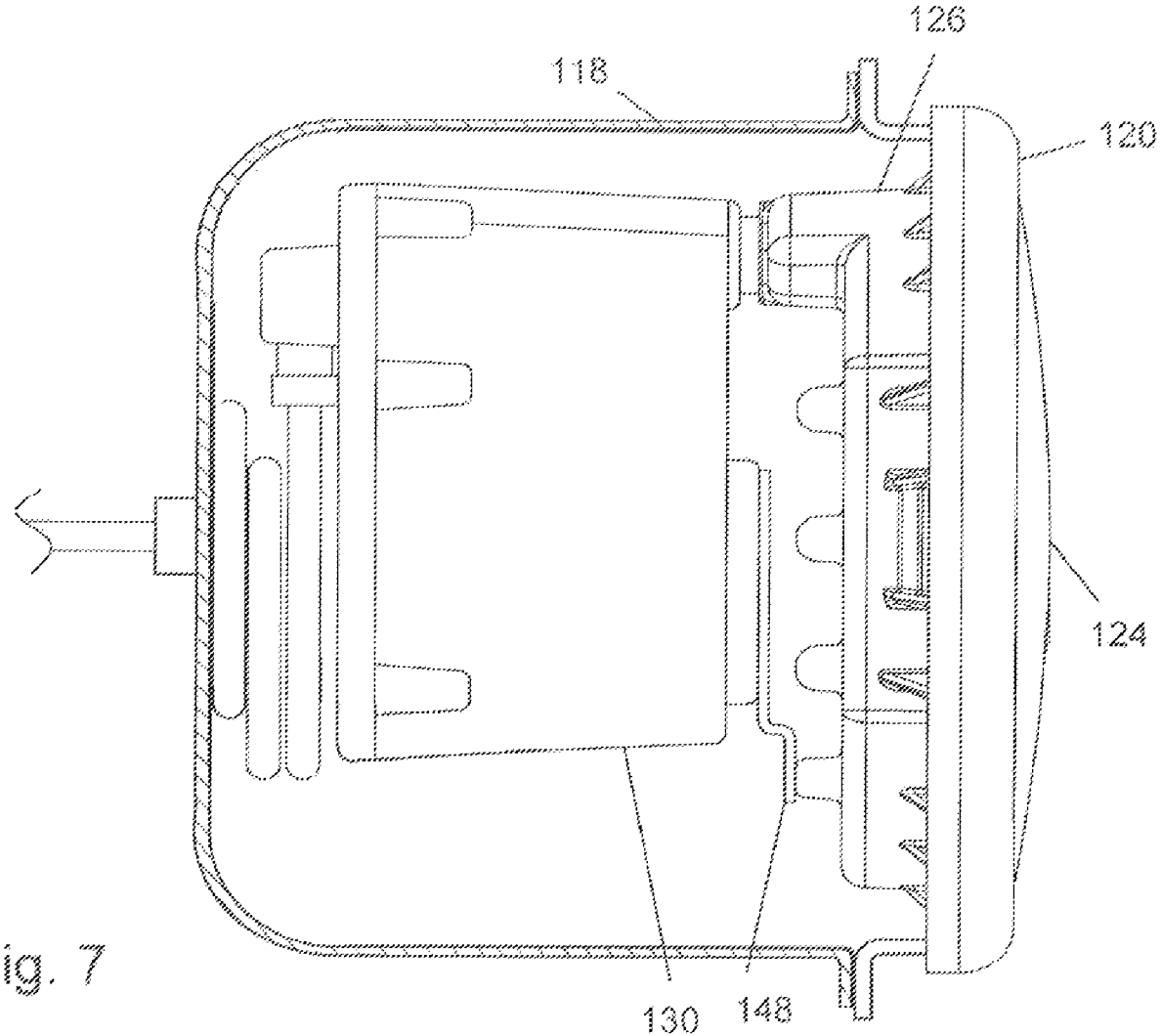
FIG. 7 is a side view in cress section illustrating the lighting system of FIG. 4 in a niche.

In the embodiment of FIGS. 4 through 7, a light fixture is illustrated in a configuration most useful for employment in the niche of a swimming pool. Of course, other applications are contemplated. FIG. 7 illustrates a niche 118 typical for the side of a pool. The niche 118 is open to the pool at one end and behind a mounting ring 120 which extends radially outwardly to cover the niche 116. Circulation holes 122 allow for water within the pool to move in and out of the niche 118. This lighting fixture associated with the niche 118 has many of the same functions as the fountain light fixture which will not be necessary to repeat here. However, the configuration does vary in notable respects which are addressed.

The mounting ring 120 is associated with the niche 118 in a typical manner. A hock on the mounting ring 120 engages one position of the niche while a screw at a diametrical location from the hook retains the mounting ring 120 in place. The lens 124 and mounting ring 120 provide a seal with the addition of a gasket on the front of the light engine bead 128. For additional safety, an electro-grid 128 located between the lens 124 and the LED light engine 56 is grounded to the chamber to capture stray currents if the seal or lens 124 falls.

The control housing 130 is associated with the light engine head 126 directly without the need for a supporting bar or light engine cable. A threaded hole 132 in the control housing 130 and a like threaded hole 134 in the light engine head 126 receive a double threaded nipple 136. The device is assembled by rotating the light engine head 124 on the control housing 130 to engage both components with the nipple 136. This creates a pass through between the control housing 130 and the light engine head 126.

The leads 138 of the LED light engine 56 and the wires 140 located in the control housing 130 define light engine connectors extending through the nipple 136, into a receptacle 142 in the control housing 130 facing the lid 144 and then into one of the receptacles in the lid 144. Potting compound is placed in the receptacle 146 found in the light engine head 124 to prevent moisture flow around the insulated light engine connectors. The assembled device may then be inverted and potting compound poured into the receptacle 146 which can form a wicking barrier at the pigtails. The light engine connectors can then be potted in the lid 144 before it is assembled with the control housing 130.

In addition to the connection through the nipple 136, the light engine head 126 and the control housing 130 are also attached by a plate 148 fastened to both the light engine head 126 and the control housing 130. This arrangement leaves a gap between these components which is open to the niche 118. Water in the niche then is able to flow between the components, cooling both and forming a thermal barrier. By stacking the components in this manner, the LED light engine 56 directs light outwardly of the niche 118 with the components stacked and thermally separated deeper into the niche. The entire assembly is supported at the front of the niche 118 by the mounting ring 120. The LED light engine 56, the power supply 76, the control gear electronics 78 and the temperature sensors 114, 116 provide similar functions to that of the first embodiment.

Thus, LED lighting systems of great utility in underwater and wet environments are here disclosed. While embodiments and applications of this invention have been shown and described, it would be apparent to those skilled in the ad that many more modifications are possible without departing from the inventive concepts herein. The invention, therefore is not to be restricted except in the spirit of the appended claims.

What is claimed is:

1. A lighting system comprising a light engine head including a chamber, a lens assembly closing the chamber and an LED light engine in the chamber and directed toward the lens assembly, the chamber being sealed with the lens assembly closing the chamber;

a control housing including a cavity thermally separate from the chamber, control gear electronics in the cavity and a power supply in the cavity;

a fixture support including a lid closing the cavity of the control housing, a beam rigidly extending from one edge of the lid and having a light engine head attachment location, the cavity being sealed with the lid closing the cavity, the light engine head being mounted to the light engine head attachment location with the control housing displaced from the light engine head.

2. The lighting system of claim 1, the light engine head further including a mounting yoke pivotally mounted at the light engine head attachment location about a first axis, the chamber being pivotally mounted to the yoke about a second axis lying in a plane normal to the first axis.

3. The lighting system of claim 1, the fixture support including a fixture attachment location between the light engine head attachment location and the lid and open away from the control housing and the light engine head for mounting attachment of the fixture support.

4. The lighting system of claim 1, the control housing further including thermally conductive potting material to dissipate heat from the cavity about the control gear electronics and about the power supply and a heat sick thermally coupled with the control gear electronics.

5. A lighting system comprising a light engine head including a chamber, a lens assembly closing the chamber and an LED light engine in the chamber directed toward the lens assembly, the chamber being sealed with the lens assembly closing the chamber;

a control housing including a cavity thermally separate from the chamber, control gear electronics in the cavity and a power supply in the cavity;

a lid closing the cavity of the control housing, the lid including first receptacles therein facing the cavity;

a power cable extending to one of the first receptacles through the lid;

potting compound in the first receptacles, the ends of the power cable including bare wire being surrounded by the potting compound in the first receptacles to form wicking barriers.

6. The lighting system of claim 5 further comprising a control cable extending to one of the first receptacles through the lid, the end of control cable including bare wire being surrounded by the potting compound in the first receptacles to form wicking barriers.

7. The lighting system of claim 5 further comprising a light engine cable extending from one of the first receptacles to the light engine head through the lid, the ends of the light engine cable also including bare wire being surrounded by the potting compound in the first receptacles to form wicking barriers.

8. The lighting system of claim 5 further comprising light engine connectors extending from the cavity of the control housing to the light engine head, the control housing further including a second receptacle in the cavity, open toward the lid and receiving the bare wire ends of the light engine connectors in the control housing and potting compound to form wicking barriers for the light engine connectors.

9. The lighting system of claim 8 further comprising an electro-grid between the LED light engine and the lens assembly, the light engine head chamber being conductive, the electro-grid being electrically connected to the chamber.

10. A lighting system comprising a light engine head including a chamber, a lens assembly closing the chamber, an LED light engine in the chamber and directed toward the lens assembly and a thermally conductive plate fixed to the chamber, the LED light engine being mounted to the thermally conductive plate, the chamber being sealed with the lens assembly closing the chamber;

a control housing including a cavity thermally separate from the chamber, control gear electronics in the cavity and a power supply in the cavity;

a first temperature sensor in the chamber, measuring the temperature of the plate at one location and in data communication with the control gear electronics, the control gear electronics being constructed and arranged to reduce power to the LED light engine with the first temperature sensor reaching a predetermined threshold temperature profile, the threshold temperature profile adjusted to compensate for the thermal drop between portions of the LED light engine.

11. The lighting system of claim 10, the control gear electronics further constructed and arranged to measure the rate of change of the data communication representing the temperature of the first temperature sensor and to vary the power input to the light engine head responsive to the rate of change to avoid visually apparent changes in light intensity.

12. The lighting system of claim 10 further comprising a second temperature sensor on and in data communication with the control gear electronics, the control gear electronics being constructed and arranged to reduce power to the LED light engine with the second temperature sensor reaching a predetermined threshold temperature profile and to measure the rate of change of the data communication representing the temperature of the first temperature sensor and to vary the power input to the light engine head responsive to the rate of change to avoid visually apparent changes in light intensity.

13. The lighting system of claim 10, the control housing further including thermally conductive potting material to dissipate heat from the cavity about the control gear electronics and about the power supply and a heat sink thermally coupled with the control gear electronics.

14. The lighting system of claim 13, the control gear electronics including a circuit board with field effect transistors, the circuit board being encased in the thermally conductive potting material and the heat sink being adjacent the field effect transistors.

15. The lighting system of claim 14, the control housing being thermally conductive, the thermally conductive potting material and the heat sink being in thermal contact with the control housing.

16. A lighting system comprising an open, underwater niche;

a light engine head including a chamber, a lens assembly closing the chamber and an LED light engine in the chamber directed toward the lens assembly, the chamber being sealed with the lens assembly closing the chamber;

a control housing including a cavity thermally separate from the chamber, a lid closing the cavity, control gear electronics in the cavity, a power supply in the cavity and thermally conductive material to dissipate heat from the cavity, the light engine head and the control housing being separated by a gap open to the niche with attachments extending there between and stacked in the niche with the lens assembly facing outwardly of the niche, the chamber being between the gap and the lens assembly.

17. The lighting system of claim 16 further comprising a mounting ring about the lens assembly, extending radially outwardly of the niche and including circulation holes in communication with the niche, the light engine head being mounted to the mounting ring.

18. The lighting system of claim 16 further comprising a lid closing the cavity of the control housing, the lid including first receptacles therein facing the cavity;

a power cable extending to one of the first receptacles through the lid;

potting compound in the first receptacles, the end of the power cable including bare wire being surrounded by the potting compound in the first receptacles to form wicking barriers;

light engine connectors extending from the cavity of the control housing to the light engine head, the control housing further including a second receptacle in the cavity, open toward the lid and receiving the bare wire ends of the light engine connectors in the control housing and potting compound to form wicking barriers for the light engine connectors;

an electro-grid between the LED light engine and the lens assembly, the light engine head chamber being conductive, the electro-grid being electrically connected to the chamber.

19. The lighting system of claim 16 further comprising a first temperature sensor in the chamber and in data communication with the control gear electronics, the control gear electronics being constructed and arranged to reduce power with the first temperature sensor reaching a predetermined threshold temperature profile, the light engine head further including a thermally conductive plate fixed to the chamber, the LED light engine being mounted to the thermally conductive plate, the first temperature sensor measuring the temperature of the plate at one location, the threshold temperature profile adjusted to compensate for the thermal drop between portions of the LED light engine.

* * * * *